United States Patent [19]

Curran

[11] Patent Number: 4,511,071

[45] Date of Patent: Apr. 16, 1985

[54] COMBINATION BACKPACK FRAME AND COT

[76] Inventor: Richard F. Curran, 1956 W. Bradley Pl., Chicago, Ill. 60613

[21] Appl. No.: 555,566

[22] Filed: Nov. 28, 1983

[51] Int. Cl.[3] ..... A45F 4/06

[52] U.S. Cl. ..... 224/156; 5/112

[58] Field of Search ..... 224/159, 153, 155, 151, 224/213, 259, 210, 156; 5/110, 111, 112, 114

[56] References Cited

U.S. PATENT DOCUMENTS

| | | | |
|---|---|---|---|
| 46,195 | 1/1865 | Weber | 224/156 X |
| 1,350,516 | 8/1920 | Pfeifer | 5/112 |
| 1,528,129 | 3/1925 | Phillips | 5/114 |
| 2,611,908 | 9/1952 | Siggers | 5/114 X |
| 3,620,428 | 11/1971 | Silverthorne | 224/156 |
| 3,730,407 | 5/1973 | Russell | 224/156 |
| 3,846,855 | 11/1974 | Peterson | 5/114 |
| 3,933,164 | 1/1976 | Ness et al. | 224/156 X |
| 4,056,857 | 11/1977 | Quantz | 5/112 |

FOREIGN PATENT DOCUMENTS

| | | | |
|---|---|---|---|
| 2361842 | 3/1978 | France | 5/114 |

*Primary Examiner*—Stephen Marcus
*Assistant Examiner*—Robert Petrik
*Attorney, Agent, or Firm*—Paul L. Hickman

[57] ABSTRACT

A combination backpack and cot characterized by a main frame assembly and a pair of extension frame assemblies slidably coupled to the main frame assembly. When the extension frame assemblies are retracted the device serves as a backpack frame, and when the extension frame assemblies are extended the device serves as a cot. A pair of webs are used to support the weight of the backpacker when the device is in its cot configuration. A first of the webs is stretched tightly across the main frame assembly and supports most of the weight of the backpacker. A second web extends between the extension frame assemblies to support the extremities of the backpacker. The extension frame assemblies can be locked into a number of intermediate positions between their retracted position and their fully extended position so that the cot can be adjusted in length to fit the backpacker.

5 Claims, 6 Drawing Figures

COMBINATION BACKPACK FRAME AND COT

BACKGROUND OF THE INVENTION

1. Field of the Invention

This invention relates generally to sports equipment, and more particularly to multi-purpose backpack frames.

2. Description of the Prior Art

Backpacking is a heathful and invigorating sport enjoyed by people all over the world. When backpacking, a person hikes into the backcountry while carrying all of the supplies and equipment that he or she needs in a frame-mounted knapsack.

Because backpackers usually wish to carry as little weight as possible, the bedding materials carried by most backpackers is quite spartan. For example, a backpacker may carry only a sleeping bag and a ground cover. Backpackers who wish to have greater creature comforts may additionally carry a foam pad or an inflatable mattress.

Most backpackers will agree that sleeping on the ground, even with a foam pad or air mattress, is far from the most healthful and restful sleeping arrangement. The hard, bumpy, sloped, and irregular ground surfaces upon which backpacker must often sleep causes many backpackers to awaken many times during the night. The lightweight foam pads which some backpackers use are usually too thin to provide a truly comfortable sleeping surface. Air mattresses are often comfortable at the time the backpacker retires for the evening but are usually flat by the time the weary and sore backpacker arises in the morning.

One solution to this problem is for the backpacker to bring along a folding cot. However, for the aforementioned weight consideration reasons, most backpackers prefer not to do this.

A solution to this dilemma has been suggested by a number of inventors who propose to form a cot out of an item already being carried by the backpacker, namely the backpack frame. For example, in U.S. Pat. No. 4,056,857 of Quantz a convertible backpack and cot is described which has two mutually slidable frame portions held together with a plurality of fastening straps. U.S. Pat. No. 3,846,855 of Peterson teaches a convertible backpack and cot including a unitary extensible frame having telescoping side and end portions.

A problem with convertible backpack/cots of the prior art is that their strength-to-weight ratio tends to be rather low. The lightweight prior art backpack/cots tend to be unsteady and unsuited for rugged use. The more sturdily constructed prior art backpack/cots tend to be too heavy to be practicable for backpacking applications.

A further problem with backpack/cots of the prior art is that they are not adjustable in length. As a consequence, prior art backpack/cots have to be designed and built to comfortably support the tallest and heaviest conceivable user of the cot, with the result that the backpack/cots are heavier and more expensive than they need to be.

SUMMARY OF THE INVENTION

An object of this invention is to provide a rugged, sturdy, and lightweight convertible backpack/cot.

An other object of this invention is to provide a convertible backpack/cot which, in its cot configuration, is adjustable in length.

Briefly, the convertible backpack/cot of the present invention includes a main frame assembly, and a pair of extension frame assemblies slidably engaged with the main frame assembly. When the backpack/cot is in its backpack configuration the extension frame assemblies are retracted against the end members of the main frame assembly and are held in place with lockpins. When the backpack/cot is in its cot configuration the extension frames are cantilevered from the main frame assembly and, once again, held in position with the lockpins.

The main frame includes a pair of U shaped end members, and two pair of slider tubes coupling the U shaped end members together. The extension frames are U shaped and each have their legs engaged with two of the slider tubes of the main frame. The lockpins extend through holes provided in the main frame to engage holes provided in the legs of the extension frames.

A main frame web is stretched across the main frame to support most of the weight of the backpacker reclining on the cot, and an extension frame web extends between the two extension frame assemblies to support the head and feet of the backpacker. A roller assembly is provided in one or both of the extension frame assemblies to tension the extension frame web. Preferably, the extension frame web is interwoven through a pair of slots provided in the main frame web so that the webs form an integral unit.

The two extension frame assemblies can be retained in a number of positions intermediate to their retracted and extended positions by use of the aforementioned lockpins. The roller assembly is used to take up the slack in the extension frame web when the extension frame members are in these intermediate positions.

Advantages of this invention include its ability to have its length adjusted and in that it has a high strength-to-weight ratio. When the extension frame members are in their retracted position they serve as reinforcements to the slider tubes of the main frame. When in use as a cot, the extension frame members are only extended far enough to accommodate the height of the backpacker and thus reduce the pressure exerted on their cantilevered juncture with the main frame. Furthermore, most of the weight of the backpacker is supported on the main frame web, which allows the extension frame members to be relatively lightweight. Thus, the combination of the extension frame and main frame construction and the use of two, interwoven support webs results in a lightweight yet extremely rugged combination backpack/cot.

These and other objects and advantages of the present invention will no doubt become apparent upon a reading of the following descriptions and a study of the several figures of the drawing.

DETAILED DESCRIPTION OF THE PREFERRED EMBODIMENT(S)

Figures 1, 5, 6:
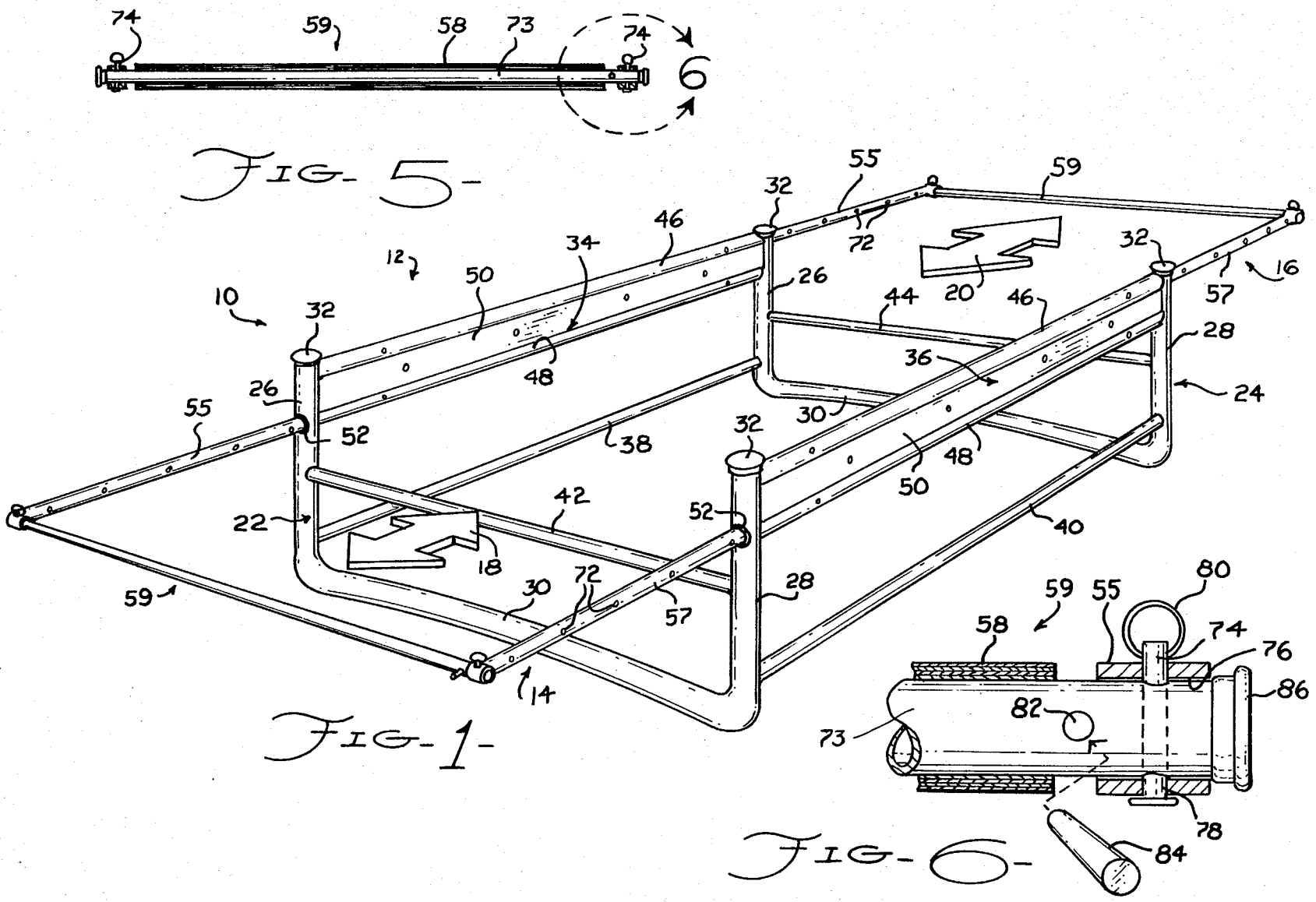
FIG. 1 is a perspective view of the main frame and extension frames of a preferred embodiment of the present invention.
FIG. 5 is a cross sectional view taken along line 5—5 of FIG. 2.
FIG. 6 is an enlarged, detail view of the portion of FIG. 5 encircled by line 6.

Referring to FIG. 1, a convertible backpack/cot 10 in accordance with the present invention includes a main frame assembly 12 and a pair of extension frame assemblies 14 and 16. As suggested by arrows 18 and 20, extension frame assemblies 14 and 16 can slide between the extended position shown in the figure, and a retracted position in abutment with main frame assembly 12.

Main frame assembly 12 includes a pair of separated, U shaped end members 22 and 24 which are preferably made from bent aluminum tubing. The end members 22/24, which are substantially identical, each have a pair of short, parallel leg portions 26 and 28, and a concave, arcuate connecting portion 30. End caps 32 cover the open ends of leg portions 26/28.

Main frame assembly 12 also includes a pair of connecting assemblies 34 and 36 which connect end members 22 and 24 together. Further bracing may be provided by longitudinal braces 38 and 40, and lateral braces 42 and 44. Connecting assemblies 34/36 each include a pair of parallel slider tubes 46 and 48, and a knapsack connection plate 50. Slider tubes 46/48 and connection plate 50 are preferably welded to each other and to the end members 22/24.

A pair of holes 52 are provided in the legs 26/28 of end member 22 in alignment with tubes 48 of connecting assemblies 34/36. A similar pair of holes 54 (see FIG. 4) are provided in the legs 26/28 of end member 24 in alignment with tubes 46 of connecting assemblies 34/36.

The extension frame assemblies 14/16 are substantially U-shaped and include first leg portions 55, second leg portions 57, and connecting portions 59. The leg portions 55/57 of extension frame assembly 14 extend through holes 52 of end member 22 to slidably engage tubes 48 of connecting assemblies 34/36. Similarly, leg portions 55/57 of extension frame 16 assembly extend through holes 52 of end member 24 to slidable engage tubes 46 of connecting assemblies 34/36.

Figures 2, 3, 4:
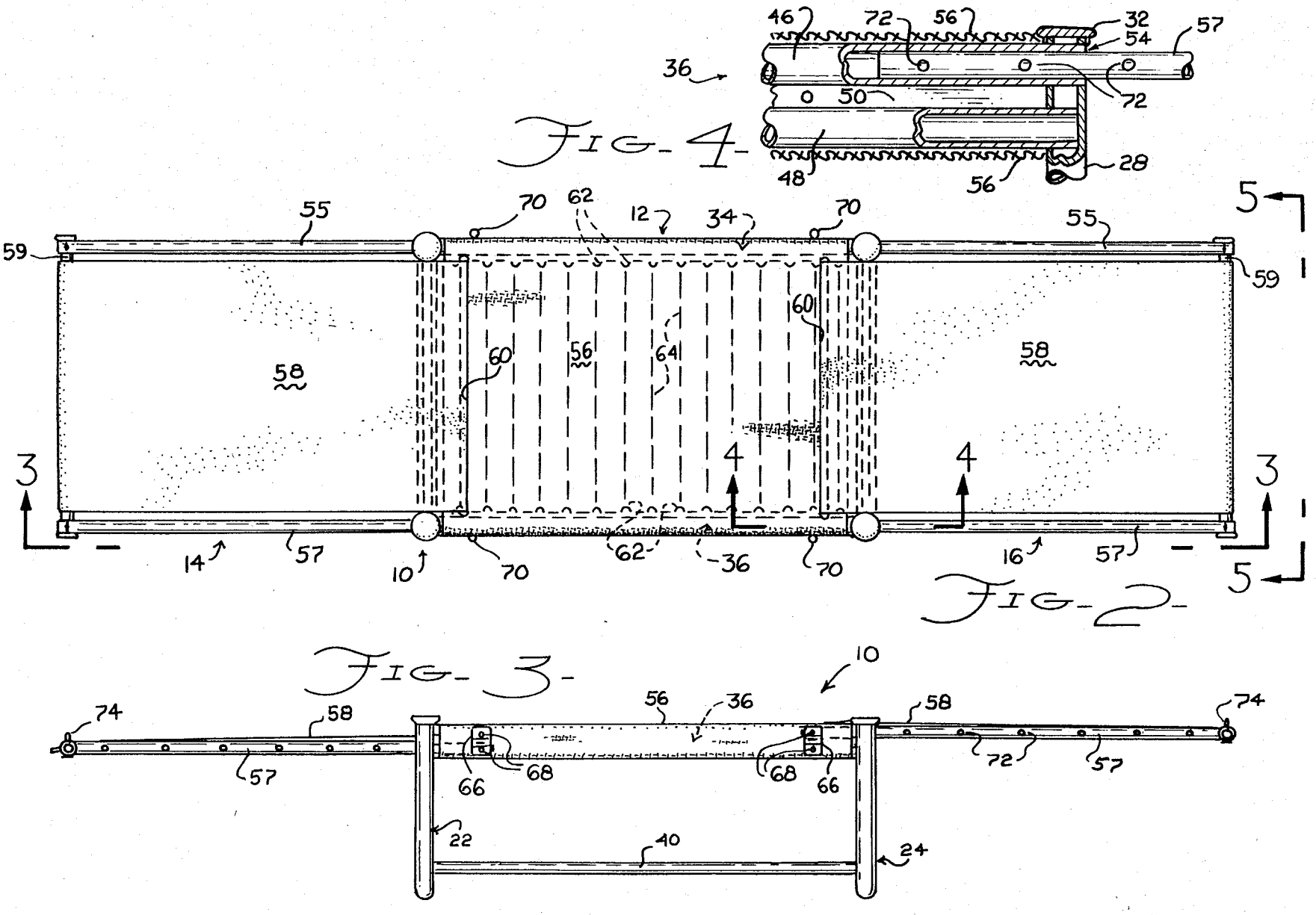
FIG. 2 is a top plan view of the device of FIG. 1 with the addition of the main frame web and the extension frame web.
FIG. 3 is a front elevational view taken along line 3—3 of FIG. 2.
FIG. 4 is a cross sectional view taken along line 4—4 of FIG. 2.

Referring now to FIGS. 2 and 3, backpack/cot 10 further includes a main frame web 56 attached to main frame 12, and an extension frame web 58 extending between extension frames 14 and 16. Main frame web 56 is preferably made from a strong, lightweight material such as 1/16 inch weave nylon mesh and is provided with ½ inch reinforced slots 60 which are receptive to the extension frame web 58. Opposing lateral edges of main frame web 56 are provided with eyelets 62 through which lacing 64 (preferably made from a strong, flexible material such as rayon) can be laced to properly hold the main frame web 56 in place around connecting assemblies 34/36.

Extension frame web 58 is preferably made from rip-stop nylon and extends between connection portion 59 of extension frame 14 and connection portion 59 of extension frame 16. The extension frame web 58 is interwoven through slots 60 of main frame web 56 and is adapted for longitudinal travel through the slots.

Referring now to FIG. 3 and the cross sectional view of FIG. 4, main frame web 56 is provided with a plurality of openings 66 near locking pin holes 68 provided in slider tubes 46 and 48. Locking pins 70 (see FIG. 2) extend through locking pin holes 68 to engage one of holes 72 provided in leg portions 55 and 57 of extension frame assemblies 14/16. This arrangement allows the length of the backpack/cot 10 to be varied.

Referring now to FIGS. 5 and 6, connection portions 59 of end members 14/16 preferably include a roller assembly including a roller tube 73 and a pair of roller tube locking pins 74. Roller tubes 73 engage lateral holes 76 through the end portions of leg portions 55/57 of extension frame assemblies 14/16. A vertical hole 78 is provided through leg portions 55/57 to accept a locking pin 74 and split rings 80 hold locking pins 74 in place. Roller tube 73 is also provided with a crank hole 82 receptive a removable crank handle 84. A plurality of end caps 86 are engaged with the ends of roller tubes 72.

In use, the present invention has two operating modes. When used as a backpack, extension members 14/16 are retracted so that connecting portions 59 abut end members 22/24 and locking in place with locking pins 70. Roller tubes 73 are rotated with crank handle 84 to take up the slack and extension frame with 58 and are then held in place with locking pins 74. A backpack of conventional design can be attached to knapsack attachment plates 50 of connecting assemblies 34/36 within the confines of the main frame assembly 12.

When used as a cot, lock pins 70 and 74 are removed and extension frame assemblies 12 and 14 are extended from main frame 12. When the backpack/cot 10 is at its desired length, lock pins 70 are reinserted into lock pin holes 68 to prevent longitudinal movement of extension frames 14/16. Crank 84 is then inserted into crank hole 82 of one or the other of roller tubes 73 to take up the slack in web 58. Locking pins 74 are used to prevent roller tubes 73 from rotating once the proper tension has been applied to web 58.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A combination backpack and cot comprising:

a main frame assembly including a first U shaped end member having a pair of upwardly extending leg portions and a connection portion, a second U shaped member having a pair of upwardly extending leg portions and a connection portion, a first pair of connecting tubes attached between a first leg portion of said first U shaped member and a first leg portion of said second U shaped member, and a second pair of connecting tubes attached between a second leg portion of said first U shaped member and a second leg portion of said second U shaped member;

a substantially rectangular main frame web having a pair of opposing longer sides and a pair of opposing shorter sides, said main frame web being supported on a first longer side by said first pair of connecting tubes, and supported on a second longer side by said second pair of connecting tubes, said first shorther side terminating proximate said first U shaped member of said main frame assembly, and said second shorter side terminating proximate said second U shaped member of said main frame assembly, said main frame web being provided with at least two elongated slots parallel to said pair of shorter sides;

first U shaped extension frame assembly having a pair of leg portions and a connecting portion, where a first leg portion of said first U shaped extension frame assembly is engagable with a first tube of said first pair of connecting tubes, and where a second leg portion of said first U shaped extension frame assembly is engagable with a first tube of said second pair of connecting tubes, such that said first U shaped extension frame may slide in and out of said main frame assembly between a retracted position and an extended, cantilever position;

first locking means for selectively affixing said first U shaped extension frame to said main frame assembly;

a second U shaped extension frame assembly having a pair of leg portions coupled together by a connecting portion, where a first leg portion of said second U shaped extension frame assembly is engagable with a second tube of said first pair of connecting tubes, and where a second leg portion of said second U shaped extension frame assembly is engagable with a second tube of said second pair of connecting tubes, such that said second U shaped extension frame may slide in and out of said main frame assembly between a retracted position and an extended, cantilever position;

second locking means for selectively affixing said second U shaped extension frame to said main frame assembly;

an elongated extension frame web engaging said two elongated slots of said main frame web, a first end of said extension frame web being supported by said connecting portion of said first U shaped extension frame, and a second end of said extension frame web being supported by said connecting portion of said second U shaped extension frame; and tensioning means for providing tension to said extension frame web.

2. A combination backpack and cot as recited in claim 1 further comprising a first backpack attachment member attached to said first pair of connecting tubes of said main frame assembly, and a second backpack attachment member attached to said second pair of connecting tubes of said main frame assembly.

3. A combination backpack and cot as recited in claim 1 wherein said connecting portion of said first U shaped extension frame is a roller engaged with said extension frame web such that rotation of said roller can cause a portion of said extension frame web to wrap around said roller's circumference to provide a tensioning force on said extension frame web.

4. A combination backpack and cot as recited in claim 3 further comprising means for rotating said roller, and means for preventing said roller from rotating.

5. A combination backpack and cot as recited in claim 4 wherein the connecting portion of said first U shaped end member of said main frame assembly and the connecting portion of said second U shaped end member of said main frame assembly arch upwardly to provide feet at the juncture between said connecting portion and the leg portions.

* * * * *